US012487005B2

(12) United States Patent
Smith et al.

(10) Patent No.: US 12,487,005 B2
(45) Date of Patent: Dec. 2, 2025

(54) FRICTION FIT VENT COVER

(71) Applicants: Mark Christopher Smith, Kamloops (CA); Matthew Robert Rodrigue, Kamloops (CA)

(72) Inventors: Mark Christopher Smith, Kamloops (CA); Matthew Robert Rodrigue, Kamloops (CA)

( * ) Notice: Subject to any disclaimer, the term of this patent is extended or adjusted under 35 U.S.C. 154(b) by 0 days.

(21) Appl. No.: 17/563,188

(22) Filed: Dec. 28, 2021

(65) Prior Publication Data

US 2023/0204250 A1 Jun. 29, 2023

(51) Int. Cl.
*F24F 13/08* (2006.01)

(52) U.S. Cl.
CPC ..... *F24F 13/084* (2013.01)

(58) Field of Classification Search
CPC ..... F24F 13/084
USPC ..... 454/289
See application file for complete search history.

(56) References Cited

U.S. PATENT DOCUMENTS 1,799,308 A * 4/1931 Matthiesen ..... E06B 9/01 49/55
5,399,180 A * 3/1995 Kopp ..... F24F 13/28 210/453

FOREIGN PATENT DOCUMENTS

CA 3037517 A1 * 9/2020

* cited by examiner

*Primary Examiner* — Allen R. B. Schult
(74) *Attorney, Agent, or Firm* — Capehart Law Firm

(57) ABSTRACT

A friction fit vent cover is configured for installation into a ventilation opening in a building surface. The friction fit vent cover includes a main frame, a pair of side panels and at least one friction fit assembly. The at least one friction fit assembly includes a spring, preferably a compression spring, which is able to be moved into an energized position (such as a compressed position). The pair of side panels are in communication with the spring and are able to slide relative to the main frame. In use, the pair of side panels are frictionally held against bordering sides of a ventilation opening when the spring is in the energized position, thereby holding the friction fit vent cover therewithin.

17 Claims, 5 Drawing Sheets

FRICTION FIT VENT COVER

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of vents of existing art and more specifically relates to a spring loaded vent cover.

RELATED ART

Heating and cooling systems are commonplace in most modern buildings as they provide a comfortable indoor climate for the occupants. Heating and cooling systems generate a flow of cool or warm air to rooms of the building through ducts and out through connected ventilation openings, or 'vents' installed within ceilings, walls and/or floors of the rooms of the building. Vent covers, such as registers, grilles, louvers, etc. are typically used to partially cover the vent, allowing a user to manually control airflow into and out of the room directly at the vent.

However, a problem with these current vent covers is that they are typically screwed into the surface in which the vent is located (such as a floor, wall or ceiling). As such, installation usually results in damage to the surface and if the vent cover needs to be replaced it is difficult to reinstall as the surface has already been comprised by the first screw. Further, these current installation methods require the use of tools. This is a particular nuisance when the vent is located in a difficult to reach location, such as on a ceiling. The installation is also potentially dangerous for the user if they must balance on a ladder whilst trying to drill screws into the surface. Thus, a suitable solution is desired.

SUMMARY OF THE INVENTION

In view of the foregoing disadvantages inherent in the known vent cover art, the present disclosure provides a novel friction fit vent cover. The general purpose of the present disclosure, which will be described subsequently in greater detail, is to provide a vent cover, such as a grille or register that easily and quickly fits into a ventilation opening without causing damage to walls, ceilings and flooring and installs without the use of tools.

A friction fit vent cover is disclosed herein. The friction fit vent cover is configured for installation into a ventilation opening in a building surface. The friction fit vent cover includes a main frame, a pair of side panels, and at least one friction fit assembly. The main frame may include an outer frame side opposite an inner frame side relative to the ventilation opening (when installed therein). The pair of side panels may be located opposite each other about the inner frame side of the main frame and extending vertically therefrom. The pair of side panels may be moveable between a neutral position and an in-use position and configured for insertion into the ventilation opening. The pair of side panels may be configured to contact bordering sides of the ventilation opening when in the in-use position.

The at least one friction fit assembly may be in communication with the pair of side panels. The at least one friction fit assembly may include a spring and a mover means that places the spring in communication with the pair of side panels. The mover means may be configured to simultaneously move the spring into an energized position and the pair of side panels into the in-use position. An opposing force exerted by the spring when in the energized position may frictionally hold the pair of side panels in the in-use position against the bordering sides of the ventilation opening, thereby holding the friction fit vent therewithin.

According to another embodiment, a method of installing a friction fit vent cover into a ventilation opening in a building surface is also disclosed herein. The method includes providing the friction fit vent cover as above; utilizing the mover means to move the spring into the energized position and the pair of side panels into the in-use position; inserting the vent cover into the ventilation opening; and selectively utilizing the mover means to remove the vent cover from the ventilation opening For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a friction fit vent cover, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to vent covers and more particularly to a friction fit vent cover that is easily and quickly installable without causing damage to walls, ceilings or flooring. The friction fit vent cover may include a spring loaded mechanism that expands or clamps on two sides of a ventilation opening to hold the friction fit vent cover in place on any floor, ceiling or wall opening. Two discrete protrusions may be located on an outer surface of the friction fit vent cover and may be expanded and/or contracted with fingers and thumbs of a user. As such, no tools are required for installation of the friction fit vent cover. Particularly, the friction fit vent cover may include a compression spring; slidable inner walls having a neutral position wider than the vent to allow for universal vent sizes; and two finger squeezable triggers (the two discrete protrusions) to compress the compression spring. The two finger squeezable triggers may be pressed to add pressure to the compression spring and lock the friction fit vent cover in place in the ventilation opening.

Referring now more specifically to the drawings by numerals of reference, there is shown in FIGS. 1-4B, various views of a friction fit vent cover 100. As shown, the friction fit vent cover 100 may comprise a main frame 110, a pair of side panels 1201, 1202 and at least one friction fit assembly 130.

Figure 1:
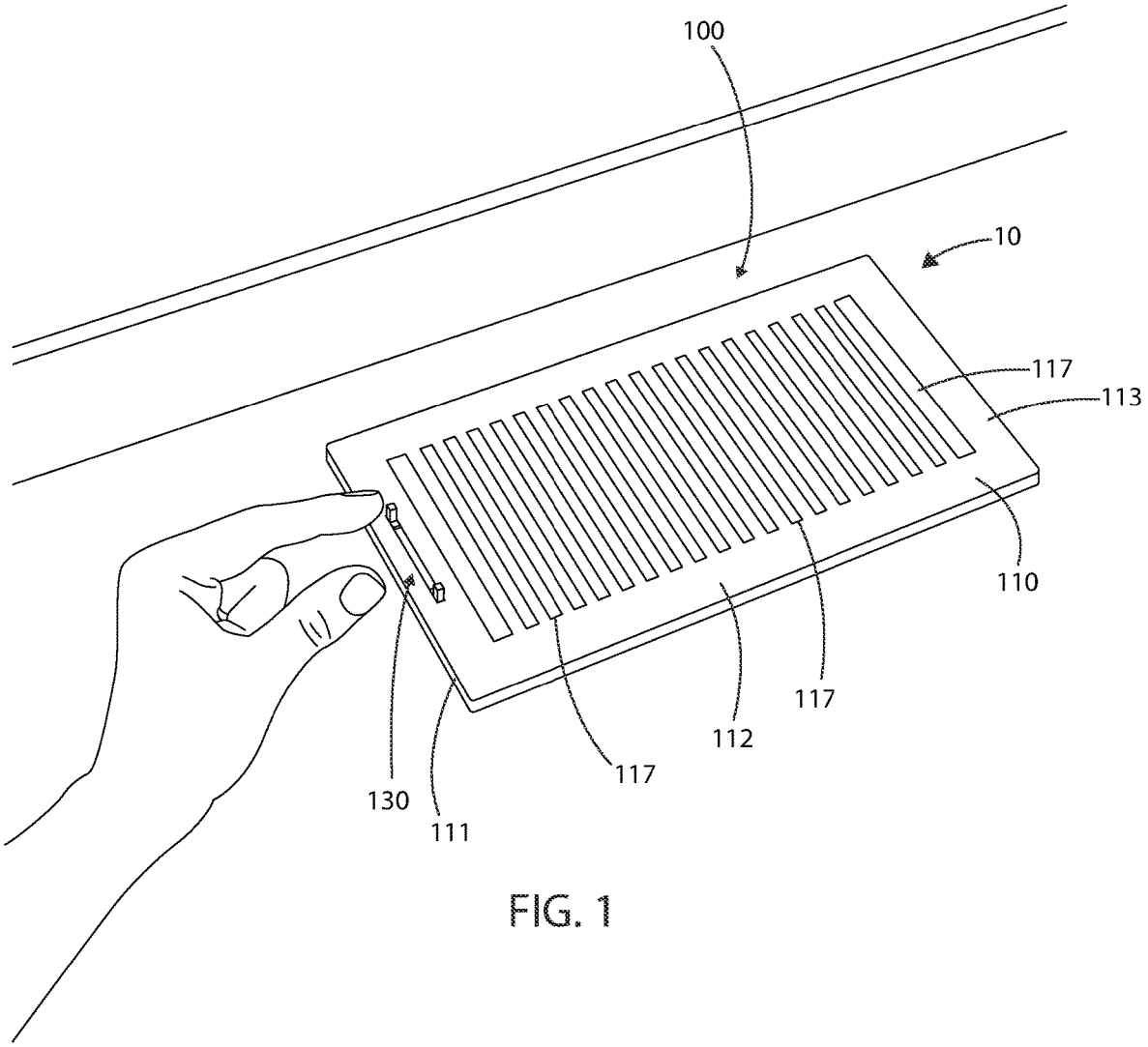
FIG. 1 is a perspective view of a friction fit vent cover installed into a ventilation opening in a building surface, according to an embodiment of the disclosure.

As shown in FIG. 1, the friction fit vent cover 100 is configured for covering a ventilation opening 5 in a building surface 10. The ventilation opening 5 is contemplated to be any ventilation opening used in the heating, cooling and/or ventilation of a building. The building surface 10 is contemplated to be any surface comprising ventilation openings therein. Particularly, a wall, floor or ceiling. The friction fit vent cover 100 is contemplated to be any "vent cover" such as a grille, register, louver, or the like.

Figure 2A:
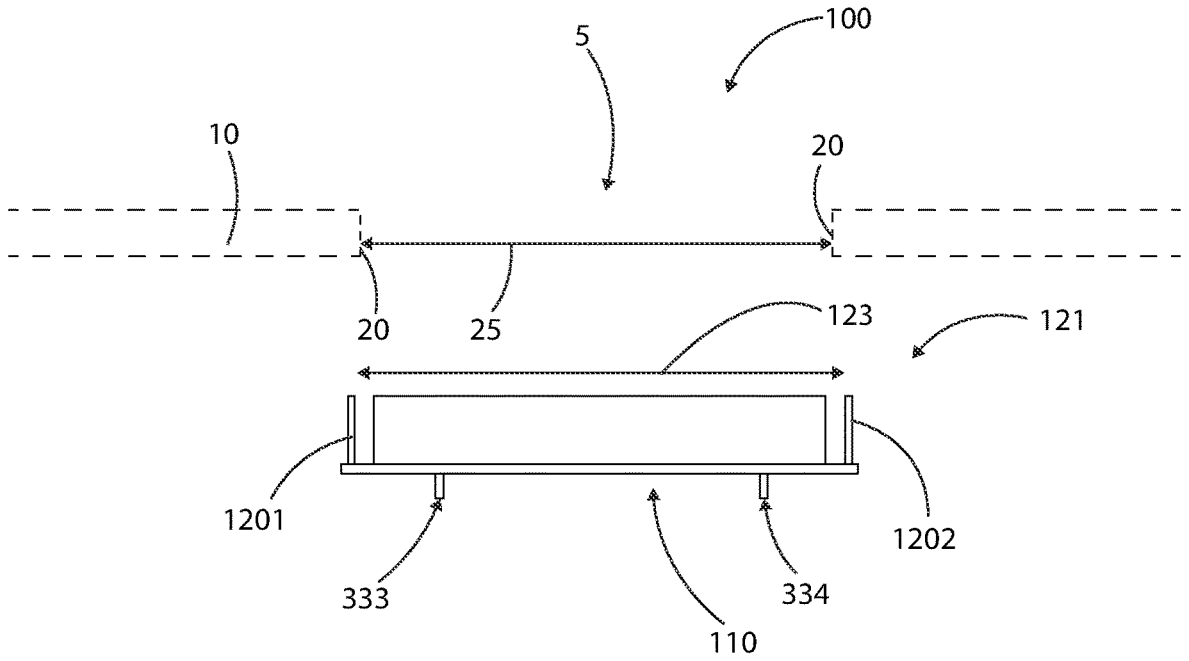
FIG. 2A is a side view of the friction fit vent cover illustrating a pair of side panels in a neutral position and relative to a ventilation opening, according to an embodiment of the present disclosure.
Figure 2B:
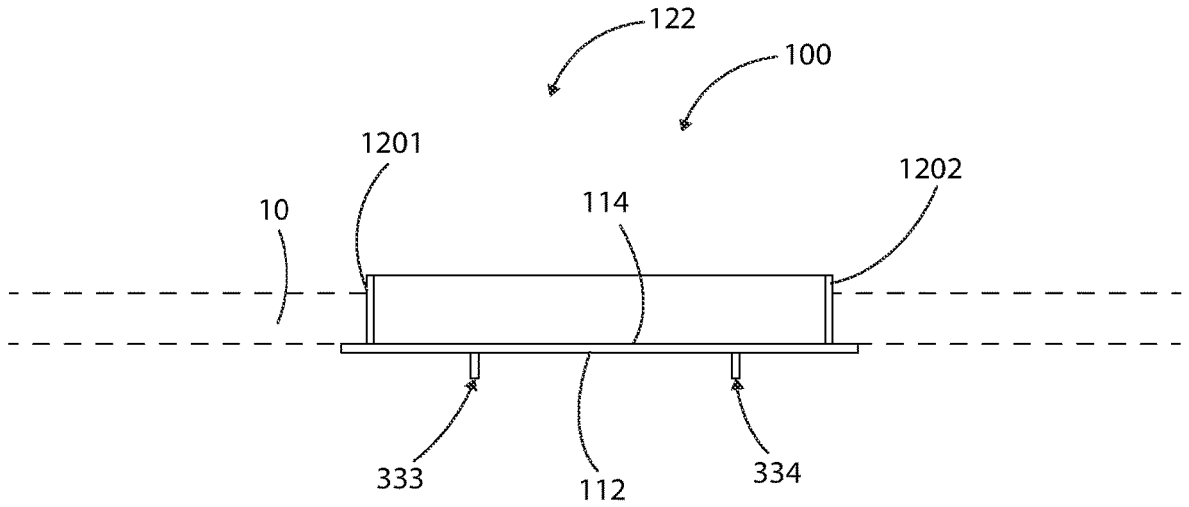
FIG. 2B is a side view of the friction fit vent cover of FIG. 2A illustrating the pair of side panels in an in-use position and installed in the ventilation opening, according to an embodiment of the present disclosure.
Figure 3:
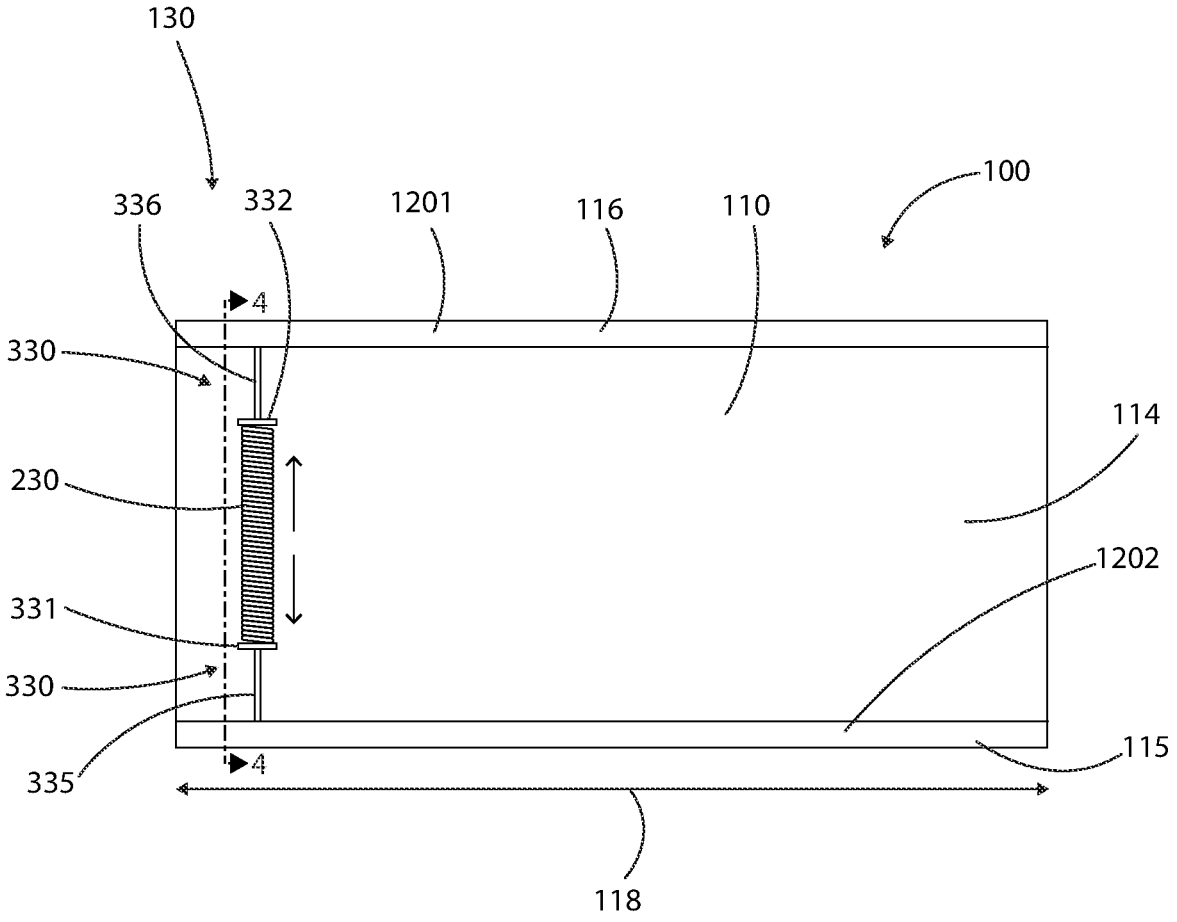
FIG. 3 is a top view of the friction fit vent cover of FIG. 2B illustrating the pair of side panels in the in-use position and having a friction fit assembly holding the friction vent cover in place, according to an embodiment of the present disclosure.

As shown in FIGS. 1-3, the main frame 110 may include an outer frame side 112 opposite an inner frame side 114 and relative to the ventilation opening 5 (when the friction fit vent cover 100 is attached therein). In some embodiments, the main frame 110 may include means for adjusting airflow through the ventilation opening 5. For example, as shown in FIG. 1, the main frame 110 may include a plurality of slats 117. In other examples, the main frame 110 may include dampers, bars, apertures, etc.

As shown in FIGS. 2A-4B, the pair of side panels 1201, 1202 may be located opposite each other about the inner frame side 114 of the main frame 110 and extending vertically therefrom. The pair of side panels 1201, 1202 may be moveable between a neutral position 121 and an in-use position 122 relative to the main frame 110. For example, in some embodiments, the pair of side panels 1201, 1202 may each be attached to a sliding track on either side of the main frame 110 (not illustrated). As shown in FIGS. 2A-2B, the pair of side panels 1201, 1202 may be configured for insertion into the ventilation opening 5 and configured to contact bordering sides 20 of the ventilation opening 5 when in the in-use position 122.

As shown, the pair of side panels 1201, 1202 may include a larger distance 123 therebetween in the neutral position 121 than in the in-use position 122 and the neutral position 121 may include the pair of side panels 1201, 1202 having a distance 123 between them larger than a width 25 of the ventilation opening 5. For example, as shown in FIG. 3 particularly, the pair of side panels 1201, 1202 may span a length 118 of the main frame 110. For instance, the one of the pair of side panels 1201, 1202 may define a front frame side 115 of the main frame 110 and the another one of the pair of side panels 1201, 1202 may define a rear frame side 116 of the main frame 110. In this embodiment, the neutral position 121 may include the pair of side panels 1201, 1202 having a distance 123 therebetween larger than the width 25 of the ventilation opening 5. Further, in some embodiments, the main frame 110 may include a second pair of side panels extending vertically from the inner frame side 114 which may not be moveable. Wherein the pair of side panels 1201, 1202 define the front frame side 115 and the rear frame side 116, the second pair of side panels may define a left frame side 111 and a right frame side 113 of the main frame 110. As such, the second pair of side panels may include a width equal or slightly lesser than the width 25 of the ventilation opening 5.

The at least one friction fit assembly 130 may be located on at least one of the left frame side 111 and the right frame side 113 of the main frame 110. For example, these figures illustrate the at least one friction fit assembly 130 being located on the left frame side 111 but it should be appreciated that the at least one friction fit assembly 130 is not limited to this location. The at least one friction fit assembly 130 may be in communication with the pair of side panels 1201, 1202. As shown in FIGS. 3-4B, the at least one friction fit assembly 130 may include a spring 230 and a mover means 330. The mover means 330 may place the spring in communication with the pair of side panels 1201, 1202 and may be configured to simultaneously move the spring into an energized position 131, and the pair of side panels 1201, 1202 into the in-use position 122. In some embodiments, the in-use position 122 may comprise two positions: a first in-use position in which the mover means 330 has moved the pair of side panels 1201 into a position in which they can be inserted into the ventilation opening 5; and a second in-use position in which the friction fit vent cover 100 is fully installed within the ventilation opening 5.

As shown in FIGS. 3-4B, the mover means 330 may include a first spring contact portion 331 attached at a first end of the spring 230, a second spring contact portion 332 attached at a second end of the spring 230, a first user-manipulable portion 333 attached to the first spring contact portion 331, a second user-manipulable portion 334 attached to the second spring contact portion 332, a first rod 335 attaching the first spring contact portion 331 to one of the pair of side panels 1201, 1202, and a second rod 336 attaching the second spring contact portion 332 to another one of the pair of side panels 1201, 1202. Preferably, the at least one friction fit assembly 130 may be made from a material and of a size able to pull and push the pair of side panels 1201, 1202 without bending, breaking, or coming loose.

Figure 4A:
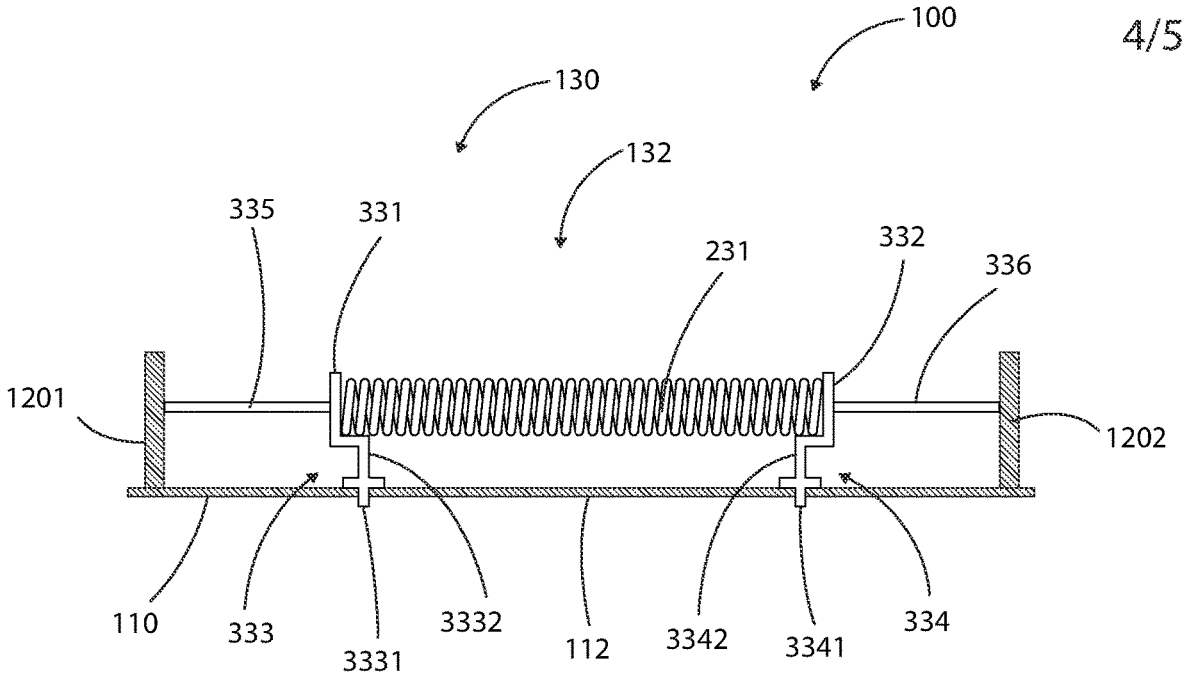
FIG. 4A is a side view of the friction fit vent cover taken along line 4-4 of FIG. 3 illustrating a compression spring of the friction fit assembly being in a resting position and the pair of side panels in the neutral position, according to an embodiment of the present disclosure.
Figure 4B:
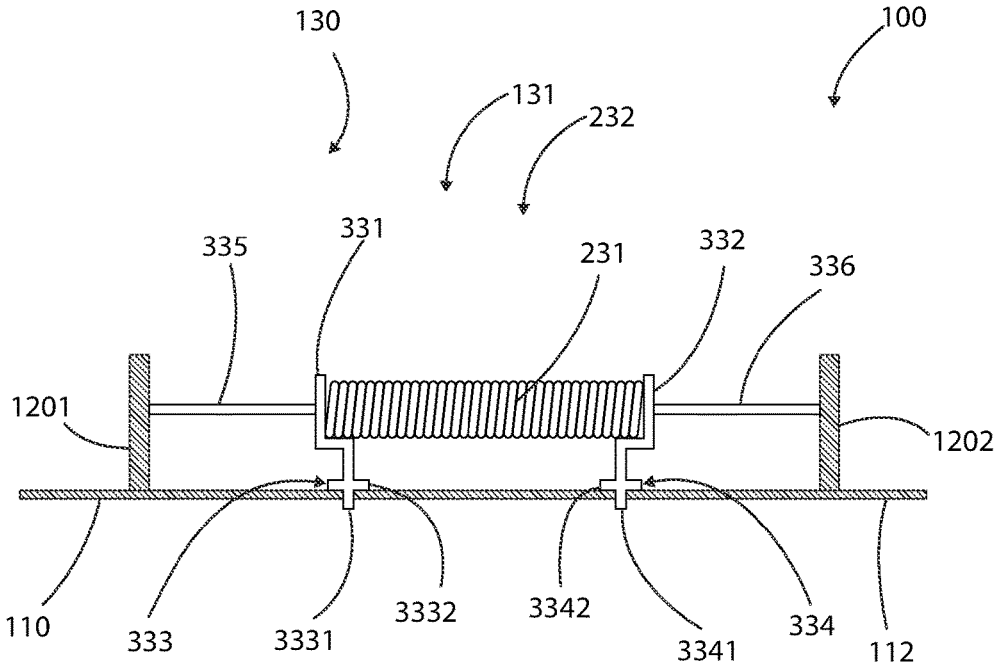
FIG. 4B is a side view of the friction fit vent cover of FIG. 4A illustrating the compression spring of the friction fit assembly being in a compressed position and the pair of side panels in the in-use position, according to an embodiment of the present disclosure.

As shown in FIGS. 4A-4B the first user-manipulable portion 333 may include a first protuberance 3331 and a first vertical shaft 3332 connecting the first protuberance 3331 to the first spring contact portion 331, and the second user-manipulable portion 334 may include a second protuberance 3341 and a second vertical shaft 3342 connecting the second protuberance 3341 to the second spring contact portion 332. The protuberances 3341, 3342 may be configured for selective linear movement relative each other. For example, the protuberances 3341, 3342 may be brought closer together or moved further apart from each other in order to move the pair of side panels 1201, 1202 and the spring 230. This action may be performed by a user simply moving the protuberances 3341, 3342 with their fingers/thumb (such as in a squeezing motion to bring the 3341, 3342 together as demonstrated in FIG. 1). In some examples, the protuberances 3341, 3342 may be attached within a protuberance track within the main frame 110 to allow them to slide relative to each other (FIG. 1).

The spring 230 may be biased toward holding the pair of side panels 1201, 1202 in the neutral position 121 and an opposing force exerted by the spring 230 when in the energized position 131 may hold the pair of side panels 1201, 1202 in the in-use position 122 against the bordering sides 20 of the ventilation opening 5, thereby holding the friction fit vent cover 100 therewithin. Preferably, the spring 230 may be a compression spring 231, and the energized position 131 may include the compression spring 231 being in a compressed position 232 (FIG. 4B). As such, when the compressed spring 231 is in a resting position 132 (FIG. 4A), the pair of side panels 1201, 1202 may be in the neutral position 121 and larger than the width 25 of the ventilation opening 5 (FIG. 2A).

When the compression spring 231 is moved into the compressed position 232 (via the mover means 330), the pair of side panels 1201, 1202 may be pulled closer together, thereby narrowing the distance 123 therebetween and allowing the user to insert the pair of side panels 1201, 1202 into the ventilation opening 5. At this stage, the distance 123 may be lesser than the width 25 of the ventilation opening 5. This may be the first in-use position discussed above. Once the user lets go of the mover means 330 when in proper position within the ventilation opening 5, the compression spring 231 may automatically spring outwardly, pushing the pair of side panels 1201, 1202 away from each other (via the mover means 330) and widening the distance 123.

The compression spring 231 may not be able to fully return to a resting position 132 however due to the resistance the opposing force meets at the bordering sides 20 of the ventilation opening 5. As such, at this stage the distance 123 between the pair of side panels 1201, 1202 will be equal to the width 25 of the ventilation opening 5, and with the opposing force of the compression spring 231 forcing the pair of side panels 1201, 1202 into the bordering sides 20 of the ventilation opening 5, the friction fit vent cover 100 will be frictionally held therewithin. This may be the second in-use position discussed above and shown in FIG. 2B.

As such, the distance 123 between the pair of side panels 1201, 1202 in the in-use position 122 may be dictated by the width 25 of the ventilation opening 5. For example, the ventilation opening 5 may be 4 inches (as in a typical 4×12 vent), and as such, the distance 123 between the pair of side panels 1201, 1202 in the (second) in-use position 122 may be 4 inches. In this example, in the neutral position 121 the distance 123 between the pair of side panels 1201, 1202 may be 6 inches to allow the compression spring 231 to be compressed a sufficient amount in order to exert a sufficient amount of opposing force when in the compressed position 232. Further, in this example, when inserting the pair of side panels 1201, 1202 into the ventilation opening 5, the distance 123 may be slightly less than 4 inches (the first in-use position) to allow the user to easily insert the pair of side panels 1201, 1202 therein and cause the compression spring 231 to gently force the pair of side panels 1201, 1202 into the bordering sides 20 of the ventilation opening 5 (into the second in-use position).

In some embodiments, as illustrated in FIGS. 4A-4B, the compression spring 231 may be moved into the compressed position 232 by bringing the first protuberance 3331 and the second protuberance 3341 closer together, thus moving the first spring contact portion 331 and the second spring contact portion 332 into the compression spring 231, compressing the compression spring 231 and pulling the pair of side panels 1201, 1202 closer (into the in-use position 122).

Further, in some embodiments, the at least one friction fit assembly 130 may include a first stop mechanism (not illustrated) in communication with the first spring contact portion 331 and a second stop mechanism (not illustrated) in communication with the second spring contact portion 332. In this embodiment, the first protuberance 3331 may include a first depressible button (not illustrated) in communication with the first stop mechanism and the second protuberance 3341 may include a second depressible button (not illustrated) in communication with the second stop mechanism. The stop mechanisms may be used for holding the compression spring 231 in the compressed position 232, or in the resting position 132.

It should be appreciated that the two side panels 1201, 1202 are not limited to being located at the length 118 (or front frame side 115 and rear frame side 116) of the main frame 110. For example, the two side panels 1201, 1202 may define or be located at the left frame side 111 and the right frame side 113. Further, it should be appreciated that the spring(s) is not limited to compression spring(s). For example, the spring(s) may be tension springs(s). In addition, other fastening means may be used. For example, the friction fit assembly may comprise spring loaded clamps.

It should also be appreciated that the at least one friction fit assembly 130 is not limited to one friction fit assembly. For example, in some embodiments, the friction fit vent cover 100 may include a first friction assembly (not illustrated) located about a left side of the pair of side panels 1201, 1202 and including a first spring and a first mover means, the first mover means placing the first spring in communication with the pair of side panels 1201, 1202; and a second friction assembly (not illustrated) located about a right side of the pair of side panels, the second friction assembly including a second spring and a second mover means, the second spring mover means placing the second spring in communication with the pair of side panels 1201, 1202. In this embodiment, the first spring mover means and the second spring mover means may be configured to simultaneously move the first spring and the second spring into the energized position 131 and the pair of side panels 1201, 1202 into the in-use position 122.

Figure 5:
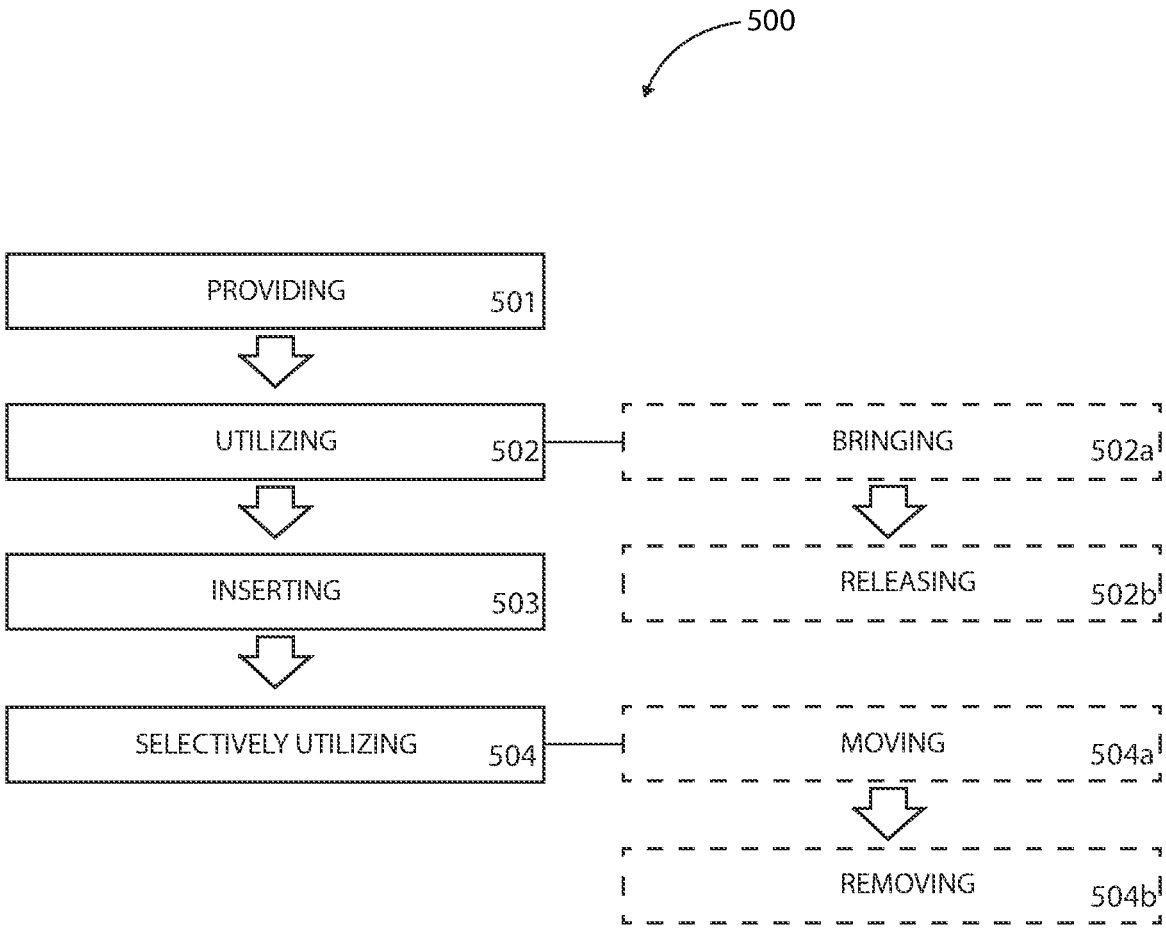
FIG. 5 is a flow diagram illustrating a method of installing a friction fit vent cover into a ventilation opening in a building surface, according to an embodiment of the present disclosure.

Referring now to FIG. 5 showing a flow diagram illustrating a method 500 of installing a friction fit vent cover into a ventilation opening in a building surface, according to an embodiment of the present disclosure. In particular, the method 500 may include one or more components or features of the friction fit vent cover 100 as described above. As illustrated, the method of use 500 may include the steps of: step one 501, providing the friction fit vent cover as above; step two 502, utilizing the mover means to move the spring into the energized position and the pair of side panels into the in-use position; step three 503, inserting the vent cover into the ventilation opening; and step four 504, selectively utilizing the mover means to remove the vent cover from the ventilation opening.

Further, in some embodiments, the step of utilizing 502 the mover means to move the spring into the energized position may include the steps of: bringing 502*a* the first protuberance and the second protuberance closer together, thereby moving the first spring contact portion and the second spring contact portion into the (compression) spring, compressing the compression spring and pulling the pair of side panels closer and into the in-use position; and releasing 502*b* the first protuberance and the second protuberance, causing the opposing force exerted by the compression spring in the compressed position to hold the pair of side panels in the in-use position against the bordering sides of the ventilation opening.

In addition, in some embodiments, the step of selectively utilizing 504 the mover means to remove the vent cover from the ventilation opening may include the steps of: moving 504*a* the first protuberance and the second protuberance closer together, thereby moving the first spring contact portion and the second spring contact portion into the compression spring, further compressing the compression spring and pulling the pair of side panels closer such that the distance therebetween is lesser than a width of the ventilation opening; and step 504*b* removing the friction fit vent cover from the ventilation opening, thereby relaxing the compression spring, pushing the pair of side panels apart and into the neutral position.

It should be noted that some steps are optional step and may not be implemented in all cases. Optional steps of method 500 are illustrated using dotted lines in FIG. 5 so as to distinguish them from the other steps of method 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a friction fit vent cover for installation into a ventilation opening in a building surface are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A friction fit vent cover for installation into a ventilation opening in a building surface, the ventilation opening having a ventilation opening width, the friction fit vent cover comprising:

a main frame including an outer frame side opposite an inner frame side relative to the ventilation opening, the main frame having a left side frame, a right side frame located opposite the left side frame, a front side panel extending between the left side frame and right side frame, and a rear side panel located opposite the front side panel and extending between the left side frame and right side frame, the left side frame, the right side frame, the front side panel and the rear side panel extending vertically away from the inner frame side of the main frame, the front side panel and the rear side panel moveable between a neutral position and a side panel energized position, wherein the distance between front side panel and the rear side panel when in the neutral position is greater than the width of the ventilation openings, and wherein the distance between front side panel and the rear side panel when in the side panel energized position is less than the width of the ventilation openings, the left side frame, the right side frame, the front side panel and the rear side panel being configured for insertion into the ventilation opening when the front side panel and the rear side panel are in the side panel energized position and configured to contact bordering sides of the ventilation opening when the front side panel and the rear side panel are in an in-use position;

a friction fit assembly in communication with the front side panel and the rear side panel, the friction fit assembly including a spring having a spring first end and a spring second end and a mover means, the mover means include a first spring contact portion attached at the spring first end, a first user-manipulable portion attached to the first spring contact portion, a first rod having a first rod first end and a first rod second end, the first rod first end being attached to the first spring contact portion, the first rod second end being attached to the front side panel, a second spring contact portion attached at the spring second end, a second user-manipulable portion attached to the second spring contact portion, and a second rod having a second rod first end and a second rod second end, the second rod first end being attached to the second spring contact portion, the second rod second end being attached to the rear side panel;

wherein the mover means is configured to simultaneously move the spring into a spring energized position and the front side panel and the rear side panel into the side panel energized position, wherein an opposing force exerted by the spring when in the spring energized position holds the front side panel and the rear side panel in the in-use position against the bordering sides of the ventilation opening, thereby frictionally holding the friction fit vent cover therewithin.

2. The friction fit vent cover of claim 1, wherein the spring is a compression spring, and wherein the spring energized position includes the compression spring being in a compressed position.

3. The friction fit vent cover of claim 1, wherein each of the front side panel and the rear side panel span a length of the main frame.

4. The friction fit vent cover of claim 3, wherein the friction fit assembly is located on at least one of a left frame side or a right frame side of the main frame.

5. The friction fit vent cover of claim 1, wherein the first user-manipulable portion includes a first protuberance and a first vertical shaft connecting the first protuberance to the first spring contact portion, and wherein the second user-manipulable portion includes a second protuberance and a second vertical shaft connecting the second protuberance to the second spring contact portion.

6. The friction fit vent cover of claim 5, wherein the first protuberance and the second protuberance are configured for selective linear movement relative each other.

7. The friction fit vent cover of claim 6, wherein bringing the first protuberance and the second protuberance closer together moves the first spring contact portion and the second spring contact portion into the compression spring, compressing the compression spring and pulling the pair of side panels closer into the in-use position.

8. A friction fit vent cover for installation into a ventilation opening in a building surface, the ventilation opening having a ventilation opening width the friction fit vent cover comprising:

a main frame including an outer frame side opposite an inner frame side and relative to the ventilation opening, the main frame having a left side frame, a right side frame located opposite the left side frame, a front side panel extending between the left side frame and right side frame, and a rear side panel located opposite the front side panel and extending between the left side frame and right side frame, the left side frame, the right side frame, the front side panel and the rear side panel extending vertically away from the inner frame side of the main frame, the front side panel and the rear side panel moveable between a neutral position and a side panel energized position, wherein the distance between front side panel and the rear side panel when in the neutral position is greater than the width of the ventilation openings, and wherein the distance between front side panel and the rear side panel when in the side panel energized position is less than the width of the ventilation openings, the left side frame, the right side frame, the front side panel and the rear side panel being configured for insertion into the ventilation opening when the front side panel and rear side panel are in the side panel energized position and configured to contact bordering sides of the ventilation opening when the front side panel and rear side panel are in an in-use position;

a friction fit assembly in communication with the front side panel and the rear side panel, the friction fit assembly including a compression spring and a mover means, the mover means include a first spring contact portion attached at the spring first end, a first user-manipulable portion attached to the first spring contact portion, a first rod having a first rod first end and a first rod second end, the first rod first end being attached to the first spring contact portion, the first rod second end being attached to the front side panel, a second spring contact portion attached at the spring second end, a second user-manipulable portion attached to the second spring contact portion, and a second rod having a second rod first end and a second rod second end, the second rod first end being attached to the second spring contact portion, the second rod second end being attached to the rear side panel, the mover means placing the compression spring in communication with the front side panel and the rear side panel;

wherein the mover means is configured to simultaneously move the compression spring into a compressed position and the front side panel and the rear side panel into the side panel energized position; and wherein an opposing force exerted by the compression spring when in the compressed position moves the front side panel and the rear side panel into the in-use position against the bordering sides of the ventilation opening, thereby frictionally holding the friction fit vent cover therewithin.

9. The friction fit vent cover of claim 8, wherein the front side panel and the rear side panel span a length of the main frame.

10. The friction fit vent cover of claim 9, wherein the friction fit assembly is located on a left frame side or a right frame side of the main frame.

11. The friction fit vent cover of claim 10, wherein the first user-manipulable portion includes a first protuberance and a first vertical shaft connecting the first protuberance to the first spring contact portion, and wherein the second user-manipulable portion includes a second protuberance and a second vertical shaft connecting the second protuberance to the second spring contact portion.

12. The friction fit vent cover of claim 11, wherein the first protuberance and the second protuberance are configured for selective linear movement relative each other, and wherein bringing the first protuberance and the second protuberance closer together moves the first spring contact portion and the second spring contact portion into the compression spring, compressing the compression spring and pulling the front side panel and the rear side panel closer into the in-use position.

13. A method of installing a friction fit vent cover into a ventilation opening in a building surface, the ventilation opening have a ventilation opening width, the method comprising the steps of:

providing the friction fit vent cover, the friction fit vent cover including:

a main frame including an outer frame side opposite an inner frame side and relative to the ventilation opening, the main frame having a left side frame, a right side frame located opposite the left side frame, a front side panel extending between the left side frame and right side frame, and a rear side panel located opposite the front side panel and extending between the left side frame and right side frame, the left side frame, the right side frame, the front side panel and the rear side panel extending vertically away from the inner frame side of the main frame, the front side panel and the rear side panel moveable between a neutral position and an side panel energized position, wherein the distance between front side panel and the rear side panel when in the neutral position is greater than the width of the ventilation openings, and wherein the distance between front side panel and the rear side panel when in the side panel energized position is less than the width of the ventilation openings, the left side frame, the right side frame, the front side panel and the rear side panel being configured for insertion into the ventilation opening when the front side panel and the rear side panel are in the side panel energized position and configured to contact bordering sides of the ventilation opening when the front side panel and the rear side panel are in an in-use position;

a friction fit assembly in communication with the front side panel and the rear side panel, the friction fit assembly including a spring having a spring first end and a spring second end and a mover means, the mover means include a first spring contact portion attached at the spring first end, a first user-manipulable portion attached to the first spring contact portion, a first rod having a first rod first end and a first rod second end, the first rod first end being attached to the first spring contact portion, the first rod second end being attached to the front side panel, a second spring contact portion attached at the spring second end, a second user-manipulable portion attached to the second spring contact portion, and a second rod having a second rod first end and a second rod second end, the second rod first end being attached to the second spring contact portion, the second rod second end being attached to the rear side panel;

wherein the mover means is configured to simultaneously move the spring into a spring energized position and the front side panel and the rear side panel into the side panel energized position, wherein an opposing force exerted by the spring when in the spring energized position the front side panel and the rear side panel in the in-use position against the bordering sides of the ventilation opening, thereby frictionally holding the friction fit vent cover therewithin;

utilizing the mover means to move the spring into the energized position and the front side panel and the rear side panel into the in-use position;

inserting the vent cover into the ventilation opening; and selectively utilizing the mover means to remove the vent cover from the ventilation opening.

14. The method of claim 13, wherein the spring is a compression spring, wherein the spring energized position includes the compression spring being in a compressed position.

15. The method of claim 14, wherein the front side panel and the rear side panel include a larger distance therebetween in the neutral position than in the in-use position, wherein the front side panel and the rear side panel further include a larger distance therebetween in the neutral position than the width of the ventilation opening, wherein the first user-manipulable portion includes a first protuberance and a first vertical shaft connecting the first protuberance to the first spring contact portion, and wherein the second user-manipulable portion includes a second protuberance and a second vertical shaft connecting the second protuberance to the second spring contact portion, and wherein the first protuberance and the second protuberance are configured for selective linear movement relative each other.

16. The method of claim 15, wherein the step of utilizing the mover means to the spring into the energized position includes bringing the first protuberance and the second protuberance closer together, thereby moving the first spring contact portion and the second spring contact portion into the compression spring, compressing the compression spring and pulling the front side panel and the rear side pane closer and into the in-use position; and releasing the first protuberance and the second protuberance, causing the opposing force exerted by the compression spring in the compressed position to hold the front side panel and the rear side pane in the in-use position against the bordering sides of the ventilation opening.

17. The method of claim 16, wherein the step of selectively utilizing the mover means to remove the vent cover from the ventilation opening includes moving the first protuberance and the second protuberance closer together, thereby moving the first spring contact portion and the second spring contact portion into the compression spring, further compressing the compression spring and pulling the front side panel and the rear side pane closer such that the distance therebetween is lesser than the width of the ventilation opening; and removing the friction fit vent cover from the ventilation opening, thereby relaxing the compression spring, pushing the front side panel and the rear side pane apart and into the neutral position.

* * * * *